United States Patent [19]

Kawashima et al.

[11] Patent Number: 4,553,465

[45] Date of Patent: Nov. 19, 1985

[54] ELECTRONIC MUSICAL INSTRUMENT PRODUCING BASS AND CHORD TONES UTILIZING CHANNEL ASSIGNMENT

[75] Inventors: Susumu Kawashima, Hamamatsu; Shigeru Yamada, Hamakita, both of Japan

[73] Assignee: Nippon Gakki Seizo Kabushiki Kaisha, Hamamatsu, Japan

[21] Appl. No.: 596,246

[22] Filed: Apr. 3, 1984

[30] Foreign Application Priority Data

Apr. 13, 1983 [JP] Japan ..... 58-065013

[51] Int. Cl.[4] ..... G10H 1/38; G10H 1/42

[52] U.S. Cl. ..... 84/1.03; 84/DIG. 12

[58] Field of Search ..... 84/1.03, DIG. 12

[56] References Cited

U.S. PATENT DOCUMENTS 4,171,658 10/1979 Aoki et al. ..... 84/1.03

4,235,142 11/1980 Nakada et al. ..... 84/1.03

4,350,068 9/1982 Suzuki et al. ..... 84/1.03 X 4,351,214 9/1982 Suzuki et al. ..... 84/1.03

*Primary Examiner*—S. J. Witkowski

*Attorney, Agent, or Firm*—Spensley, Horn, Jubas & Lubitz

[57] ABSTRACT

An electronic musical instrument is of a type in which tones are produced by a limited number of tone production channels which are efficiently used for a larger number of tones utilizing channel assignment technology. Normally, three of the channels are exclusively occupied for production of three tones to constitute a triad chord. But at time a bass tone is to be produced, the specific one of the three channels is compulsively used for production of the bass tone, giving up exclusivity for production of the chord tone. This eliminates the need of providing an additional channel for the bass tone production.

2 Claims, 3 Drawing Figures

ELECTRONIC MUSICAL INSTRUMENT PRODUCING BASS AND CHORD TONES UTILIZING CHANNEL ASSIGNMENT

BACKGROUND OF THE INVENTION (a) Field of the Invention

The present invention relates to an electronic musical instrument having a plurality of musical tone production channels capable of producing bass and chord tones.

(b) Description of the Prior Art

Those electronic musical instruments placed on the market recently are arranged so that the key data representative of the keys depressed on the keyboard and the key data generated in the musical instrument for the purpose of automatic accompaniment are assigned appropriately to a plurality of musical tone forming channels which are provided in the instrument in a number far smaller than the total number of the keys provided on the keyboard, and that a plurality of musical tones can be produced concurrently. In such an arrangement, these plurality of tone production channels are allotted for the formation of melody tones, chord tones, bass tones and other automatic accompaniment tones, respectively. In order to simplify the circuitry and to thereby reduce the manufacturing cost of the musical instrument, however, the number of these channels preferably is the smaller the better.

SUMMARY OF THE INVENTION

It is an object of the present invention to provide an improved electronic musical instrument arranged so that various kinds of musical tones can be produced with a small number of tone production channels.

Considering that, in an electronic musical instrument performance, there exist such tones as the combination of chords and bass tones which are seldom produced simultaneously from the instrument from the viewpoint of performance patterns, the present invention has, as its object, to provide an improved electronic musical instrument arranged so that at least one of a plurality of tone production channels is alternately used in common for the production of different kinds of tones while all the rest are used exclusively for the production of respective particular kinds of tones. More specifically, the electronic musical instrument according to the present invention is arranged so that, taking up the example of a combination of chord tones and bass tones in explaining this invention, at tone production timings of chord tone, those key data corresponding to the chord-constituent notes are assigned to a plurality of tone production channels, respectively, to produce the chord tones, whereas at each bass tone production timing, a bass note key data is assigned to one of said plurality of tone production channels, whereby eliminating the need for the provision of an additional special tone production channel intended for the bass tone.

DETAILED DESCRIPTION OF THE PREFERRED EMBODIMENT

Figure 1A:
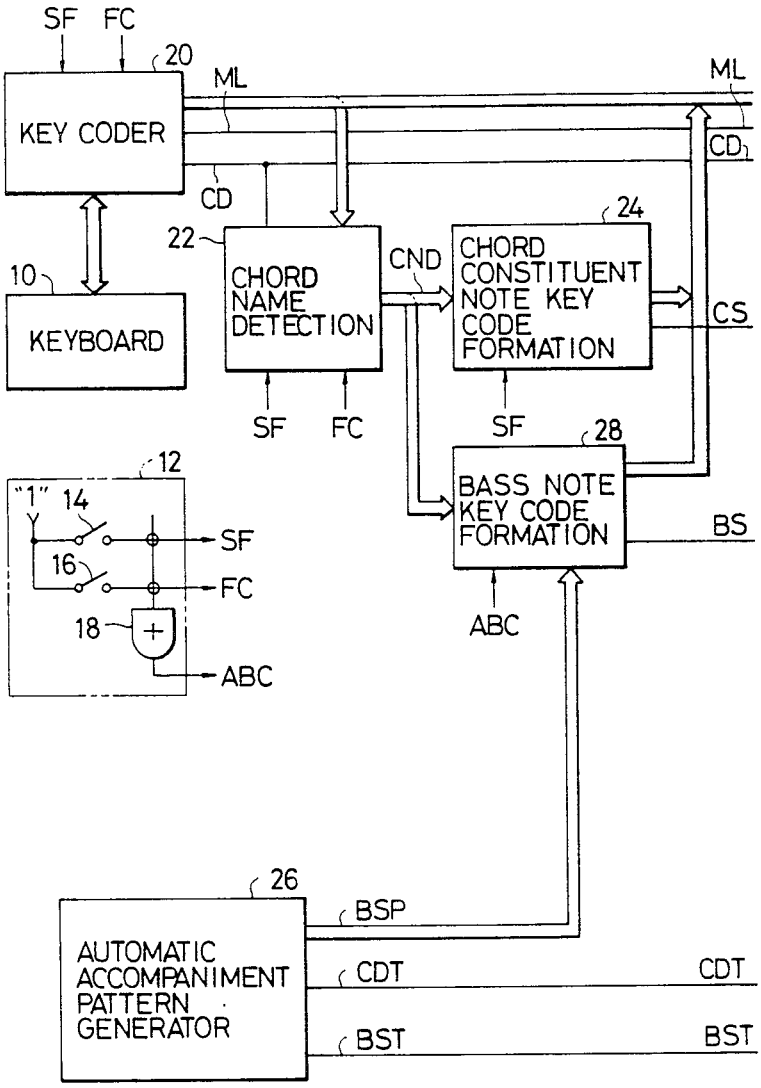
FIGS. 1A and 1B, in combination, are a block diagram showing the circuit arrangement of an electronic musical instrument according to an embodiment of the present invention.
Figure 1B:
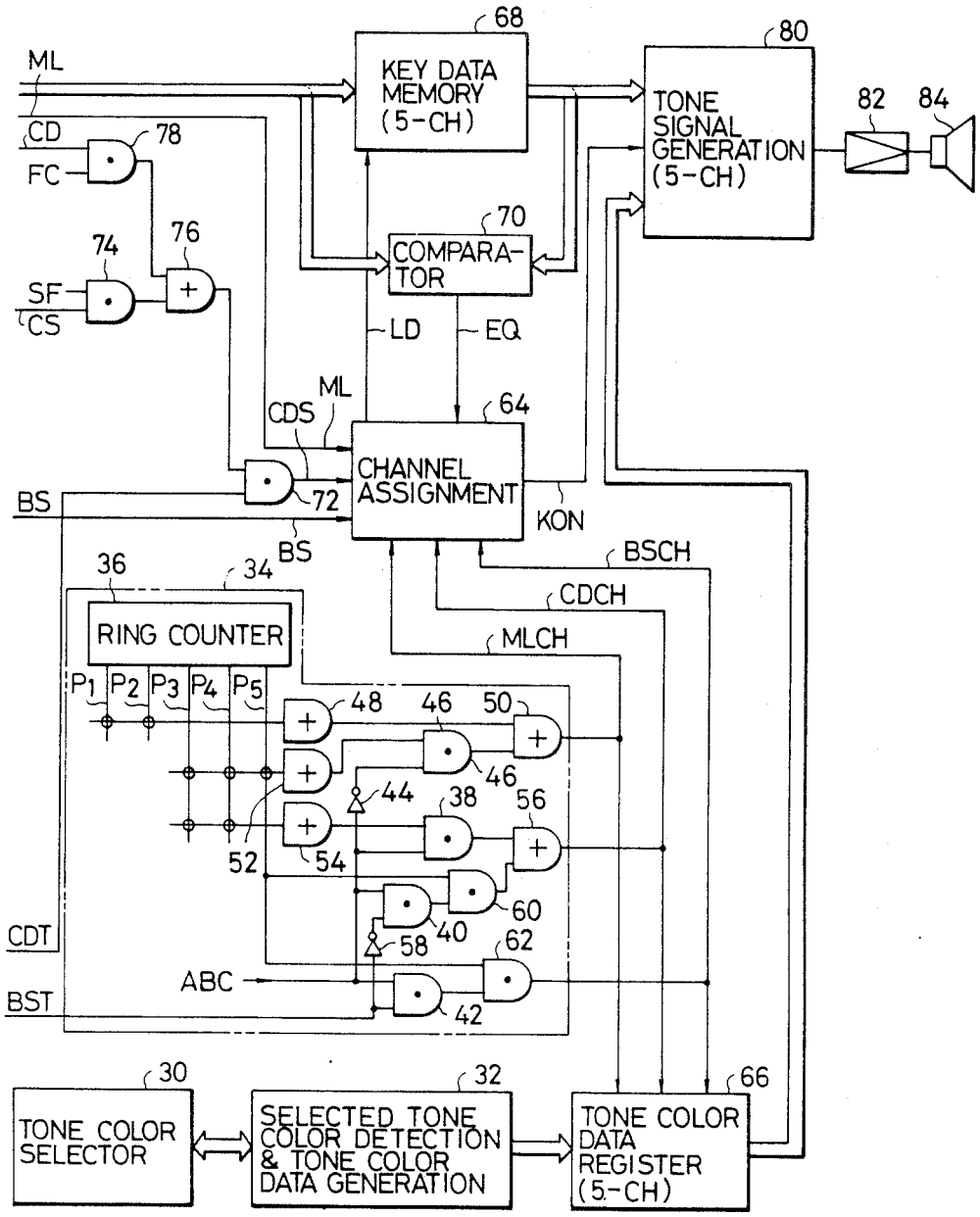

FIGS. 1A and 1B, in combination, show the circuit arrangement of an electronic musical instrument according to an embodiment of the present invention.

A keyboard circuitry generally indicated at 10 includes an upper keyboard region and a lower keyboard region (an upper keyboard and a lower keyboard in the case of a double or more manual instrument, or an upper fraction and a lower fraction of a same keyboard in the case of a single manual instrument), and a large number of key switches corresponding to the large number of keys in these two keyboard regions.

In a mode setting circuit 12, let us assume that a switch 14 is turned on. Whereupon, there is generated a single finger mode signal SF="1". When a switch 16 is actuated, a fingered chord mode signal FC="1" is generated. When either the switch 14 or the switch 16 is turned on, there is generated an automatic bass chord mode signal ABC through an OR gate 18.

In the normal mode wherein the mode signal ABC is "0", it is possible to perform a melody playing on the entire upper and lower keyboard regions of the keyboard circuitry 10. Also, in the automatic bass chord mode wherein the mode signal ABC is "1", a melody playing can be performed in the upper keyboard region, whereas an accompaniment playing using, for example, chords can be made in the lower keyboard region of the keyboard circuitry 10.

A key coder 20 is arranged to be operative so that it scans sequentially and repetitively the key switches for all the keys of both the upper and lower keyboard regions in the keyboard circuitry 10 to detect the depressed keys. In case the mode signal SF or FC is "1" (meaning that this is the automatic bass chord mode), the key coder generates key code data representing the melody keys depressed in the upper keyboard region together with a data category signal ML="1", and concurrently this key coder generates key code data corresponding to the accompaniment keys depressed in the lower keyboard region together with a data category signal CD="1". In case the mode signals SF and FC are both "0" (meaning the normal mode), this key coder generates key code data representing the melody keys depressed in both the upper and lower keyboard regions and also generates a data category signal ML="1". It should be understood here that the data category signals ML and CD indicate that the key code data delivered are melody key code data and accompaniment key code data, respectively.

A chord name detecting circuit 22 is arranged so that the accompaniment key code data supplied from the key coder 20 is loaded there in accordance with the presence of the data category signal CD, and detects the chord name (identified by a root note and a chord type) to thereby generate chord name data CND (including a root note data and a chord type data). The chord name detecting operation is to identify the root note and the type of the chord based on the accompaniment key code data, and this identifying or judging manner would vary depending of which one of the mode signals SF and FC is "1".

More specifically, in case the mode signal SF="1", it should be noted that, if the number of the depressed key is just 1 (one), this circuit 22 will judge that this depressed key represents the root note of the chord and the type of the chord is major. If, on the other hand, a plurality of keys have been depressed simultaneously, this circuit 22 will determine that the key having the highest pitch among the plurality of depressed keys represents the root note of the chord, and concurrently therewith it determines that the type of the chord is minor, seventh and so forth in accordance with the number of the other depressed keys or with the kind, such as a natural key or a sharp key, of the depressed keys. Also, in case the mode signal FC="1", the circuit 22 will determine the root note and the type of the chord from a plurality of (usually three) key code data resulting from the depression of the chord keys in the lower keyboard region.

A chord constituent note key code forming circuit 24 is arranged to form, in accordance with the chord name data CND when the mode signal SF="1", a plurality of key code data representative of the chord constituent notes (e.g. C, E and G in the case of C major triad chord) which are to be sounded. These chord constituent note key code data are delivered out together with the data category signal CS="1" at a predetermined timing at each end of one scanning of the entire keys done by the key coder 20 (i.e. at each ending part of one scanning cycle). It should be noted here that the data category signal CS is indicative of the fact that the delivered-out key code data are the chord constituent note key code data.

An automatic accompaniment pattern generator 26 is so arranged as to generate bass note decisive data BSP, chord timing signal CDT, and bass timing signal BST in accordance with a predetermined automatic accompaniment pattern. Respective bass note decisive data BSP are adapted to indicate the interval degrees of the bass notes which are to be sounded with respect to the root note of the chord. Also, the chord timing signal CDT and the bass timing signal BST are arranged to instruct the timings of their sounding which usually do not coincide with each other.

A bass note key code forming circuit 28 is designed to form key code data representing the bass notes which are to be sounded, in accordance with the chord name data CND and the bass note decisive data BSP in case the mode signal ABC is "1". The bass note key code data thus formed are delivered out along with the data category signal BS="1" at a predetermined timing for each completion of one scanning cycle of the key coder 20. It should be noted here that the data category signal BS indicates that the delivered-out key code data represent the bass note key code data.

A tone color selector 30 contains, on the panel surface of the body of the musical instrument, a number of tone color selection manipulation knobs which are provided for various categories of musical tones, respectively, such as for melody, chord, bass and so forth. A selected tone color detection and tone color data generation circuit 32 is arranged to detect, by scanning, the tone color selected in the tone color selector 30 and to generate tone color data for respective categories of tones.

A channel assignment controlling circuit 34 has a ring counter 36 which generates sequential pulses $P_1 \sim P_5$ in correspondence to the first to fifth channel timings. The operation speed of this counter 36 is set quick (e.g. 1 micro-second per pulse) so as to twice repeat the cycle of generation of the sequential pushes $P_1 \sim P_5$ within the duration of one key code data.

The sequential pulses $P_1 \sim P_5$ delivered from the ring counter 36 are used for the formation of: a channel assignment timing signal MLCH for a melody tone, a channel assignment timing signal CDCH for a chord tone, and a channel assignment timing signal BSCH for a bass tone, in accordance with the mode signal ABC and the bass timing signal BST.

Which one of these signals MLCH, CDCH and BSCH is formed from these respective pulses in accordance with the state of the signals ABC and BST is as shown in the following table.

TABLE

| | $P_1$ | $P_2$ | $P_3$ | $P_4$ | $P_5$ |
|---|---|---|---|---|---|
| ABC = "0" | MLCH | MLCH | MLCH | MLCH | MLCH |
| ABC = "1" BST = "0" | MLCH | MLCH | CDCH | CDCH | CDCH |
| ABC = "1" BST = "1" | MLCH | MLCH | CDCH | CDCH | BSCH |

More specifically, in case of the normal mode wherein the mode signal ABC="0", AND gates 38, 40 and 42 are in their disabled state, and the output signal "1" of an inverter 44 enables an AND gate 46. As a result, the sequential pulses $P_1$ and $P_2$ are delivered out as the channel assignment timing signal MLCH for melody tones via OR gates 48 and 50, while the sequential pulses $P_3 \sim P_5$ are delivered out as the signal MLCH via an OR gate 52, the AND gate 46 and the OR gate 50.

Also, in case of the automatic bass chord mode wherein the mode signal ABC="1", the sequential pulses $P_1$ and $P_2$ are delivered out as the signal MLCH as in the abovementioned instance. And, since the AND gate 38 is enabled, while the AND gate 46 is disabled by the output signal "0" of the inverter 44, the sequential pulses $P_3$ and $P_4$ are delivered out as the channel assignment timing signal CDCH for chord tones via an OR gate 54, the AND gate 38 and an OR gate 56. In such an instance, if the bass timing signal BST is "0" and therefore does not instruct the production of a bass tone, it will be understood that the AND gate 42 is disabled while the AND gate 40 enables an AND gate 60 in accordance with the output signal "1" of an inverter 58, the pulse $P_5$ is delivered out as the signal CDCH for a chord tone via the AND gate 60 and the OR gate 56. In contrast thereto, when the bass timing signal BST is "1" and thereby instructing the production of a bass tone, an AND gate 62 is enabled in accordance with the output signal "1" of the AND gate 42, while the AND gate 40 is disabled by the output signal "0" of the inverter 58. Therefore, the pulse $P_5$ is delivered out as the channel assignment timing signal BSCH for a bass tone via the AND gate 62.

The channel assignment timing signals MLCH, CDCH and BSCH outputted from the channel assignment controlling circuit 34 are supplied to a channel assignment circuit 64 and to a tone color data register circuit 66 for five channels. Arrangement is provided so that this channel assignment circuit 64 is supplied also with the comparison output (coincidence signal) EQ from a comparator 70 which compares the input and output data of a key data memory 68, the data category signal ML from the key coder 20, the data category signal CDS from an AND gate 72, and the data category signal BS from the bass note key code forming circuit 28. Here, the data category signal CDS from the AND gate 72 should be understood to be generated only when the chord timing signal CDT is "1" for instructing the sounding of chord tones. When the mode signal SF is "1", the signal CDS is comprised of the data category signal CS which is supplied to the AND gate 72 through an AND gate 74 and an OR gate 76, whereas when the mode signal FC is "1", it is comprised of the data category signal CD which is supplied to the AND gate 72 via an AND gate 78 and the OR gate 76.

The key data memory 68, as an example, has, as disclosed in U.S. Pat. No. 4,351,214, a data storing means which comprises, for example, a shift register having a circulatory loop, and it has first to fifth time division multiplexed type memory channels. To this key data memory 68 are fed melody note key code data from the key coder 20, accompaniment note key code data from the key coder 20, chord constituent note key code data from the chord constituent note key code forming circuit 24, and bass note key code data from the bass note key code forming circuit 28. The loading of the respective key code data onto the respective memory channels (i.e. channel assignment) is controlled by a load instruction signal LD supplied from the channel assignment circuit 64.

The channel assignment circuit 64 has, as shown in, for example, the above-mentioned U.S. Patent, a key-on register having first to fifth memory channels. Arrangement is provided so that there is generated thereform a tone generation control signal KON indicative of either key-on ("1") or key-off ("0"), for each channel timing. In case "1" is stored in all of the five channels of the key-on register, there is carried out no further channel assignment since all these channels have been occupied. Also, when the comparison output EQ from the comparator 70 is "1", this means that a key code data same as the key code data which has arrived at the key data memory 68 has already been stored in the memory 68, so that no channel assignment is carried out either.

In synchronism with the loading of a key code data onto a particular memory channel of the key data memory 68, there is stored "1" in the corresponding memory channel of the key-on register, whereby the production of a corresponding musical tone becomes feasible. Also, when the comparison output EQ from the comparator 70 changes from "1" to "0" with respect to a particular memory channel, this is judged to mean that a key is released, so that the corresponding memory channel of the key-on register is cleared to "0", and in response thereto, it becomes possible to control the decay of the musical tone which is being sounded.

The tone color data register circuit 66 has first to fifth time division multiplexed type memory channels as in the cases of the key data memory 68 and the above-mentioned key-on register. Arrangement is provided so that a tone color data for each category of musical tones is supplied from the selected tone color detection and tone color data generation circuit 32.

In case of the normal mode, the channel assignment controlling circuit 34 delivers out sequential pulses $P_1 \sim P_5$ as a channel assignment timing signal MLCH for melody tones. Accordingly, tone color data for the melody tones are loaded, at the timings of the pulses $P_1 \sim P_5$, onto the first to fifth memory channels, respectively, of the tone color data register circuit 66, and after that, they are stored in a circulatory manner.

Also, in case of the automatic bass chord mode, the channel assignment timing signal MLCH for melody tones contains sequential pulses $P_1$ and $P_2$, and accordingly, the tone color data for melody tones is loaded, respectively, on the first and second memory channels of the tone color data register 66 in a manner similar to that of the abovementioned normal mode. And, the manner that the tone color data are loaded onto the third to fifth memory channels of the tone color data register circuit 66 would vary depending on the state of the bass timing signal BST.

More specifically, in case the bass timing signal BST is "0", the tone color data for chord tones is loaded onto the third to fifth memory channels, respectively, at the timings of the pulses $P_3 \sim P_5$ contained in the channel assignment timing signal CDCH for the chord tones. In case the bass timing signal BST is "1", the tone color data for the chord tones is loaded onto the third and fourth memory channels, respectively, at the timings of the pulses $P_3$ and $P_4$ contained in the channel assignment timing signal CDCH for the chord tones. Concurrently therewith, the tone color data for a bass tone is loaded onto the fifth memory channel at the timing of the pulse $P_5$ contained in the channel assignment timing signal BSCH for the bass tone.

Also these various kinds of tone color data which have been loaded onto the tone color data register circuit 66 as stated above are stored in this circuit 66 in a circulatory manner.

A tone signal generating circuit 80 generates a tone signal based on the key code data delivered out in a time division multiplexed fashion from the key data memory 68, the tone generation control signal KON delivered out in a time division multiplexed fashion from the channel assignment circuit 64, and on the tone color data delivered out in a time division multiplexed fashion from the tone color data register circuit 66, and this circuit 80 is provided with first to fifth tone production channels. These tone production channels may be of either one of the following two types, i.e. a time division multiplexed type and a spatially discrete type. As the method for generating tone signals, there can be employed any desired one from among the waveform memory read-out method, the filter method, the frequency modulation method, arithmetic operation method and so forth.

The tone signal generating circuit 80 has five tone production channels, and accordingly it is capable of generating tone signals for five tones at the same time. The type of the tone signals thus generated, however, would vary as will be described later, depending on the normal mode and the automatic bass chord mode. The tone signals delivered out from the tone signal generating circuit 80 are supplied to a loudspeaker 84 via an output amplifier 82, to be transformed into sounds.

Next, description will be made of the channel assignment and tone production operation for each of the instances of the normal mode and the automatic bass chord mode. For the sake of simplicity, it is hereby assumed that the respective memory channels of the key data memory 68 and the key-on register are invariably set ready for being written in.

NORMAL MODE

In this mode, it should be noted that, in the keyboard circuitry 10, both the upper keyboard region and the lower keyboard region are set to function for melody playing.

Let us here assume that the key coder 20 has detected one melody key depression in either one of the upper and lower keyboard regions. Whereupon, a melody note key code data representative of this key depression is applied to the key data memory 68, and concurrently therewith, a data category signal ML="1" is supplied to the channel assignment circuit 64. At such a time, sequential pulses $P_1 \sim P_5$ are being fed, as the channel assignment timing signal MLCH for the melody tones, from the channel assignment controlling circuit 34 to the channel assignment circuit 64 and to the tone color data register circuit 66.

The channel assignment circuit 64 generates a load instruction signal LD at the timing of, for example, the pulse $P_1$. In response thereto, a melody note key code data is loaded onto the first memory channel of the key data memory 68, and thereafter, this data is stored in a circulatory manner. Also, "1" is loaded, in synchronism with the data loading onto the memory 68, onto the first memory channel of the key-on register within the channel assignment circuit 64, and thereafter it is stored in a circulatory manner.

Let us here assume that, simultaneously with the above-mentioned melody key depression, another different melody key depression is performed. In a manner similar to that just described above, a melody note key code data representative of said another melody key depression is stored in the second memory channel of the key data memory 68, and "1" is stored also in the second memory channel of the key-on register. And, in a manner similar to that just described above, it is possible to store, in the key data memory 68 and in the key-on register, those data for five keys which are depressed concurrently.

In the tone color data register circuit 66, the tone color data for the melody tones is stored in the first to fifth memory channels in accordance with the channel assignment timing signal MLCH for melody notes as stated above.

Accordingly, the tone signal generating circuit 80 generates a melody tone signal based on a melody note key code data supplied from the key data memory 68, a tone generation control signal KON supplied from the key-on register, and a tone color data for the melody tones from the tone color data register circuit 66. In response thereto, a melody tone in a melody tone color is delivered out from the loudspeaker 84. It should be noted here that, when the data for a plurality of keys (five keys at most) which have been depressed simultaneously have been stored in both the key data memory 68 and the key-on register, there are sounded simultaneously from the loudspeaker 84 a plurality of melody tones representative of the depressed plural keys.

AUTOMATIC BASS CHORD MODE

In this mode, in the keyboard circuitry 10, the upper keyboard region is set for melody playing, and the lower keyboard region will serve for accompaniment playing.

In case of a melody playing performed in the upper keyboard region, the channel assignment controlling circuit 34 delivers out sequential pulses $P_1$ and $P_2$ to serve as the channel assignment timing signal MLCH for melody tones. Accordingly, it is possible to produce two melody tones by using the first and second memory channels of the key data memory 68 in a manner similar to that described above. It should be noted that, in this specific mode, it is those melody tones representative of the two keys depressed in the upper keyboard region that can be sounded simultaneously.

On the other hand, in case an accompaniment key depression is performed in the lower keyboard region for the production of, for example, tones for a triad, and if the mode signal FC is "1", the key coder 20 generates chord constituent note key code data representative of the triad depressed in the lower keyboard region, and it also generates a data category signal CD="1". In case of the mode signal SF="1", the chord constituent note key code forming circuit 24 generates chord constituent note key code data corresponding to the triad designated in the lower keyboard region, and it also generates a data category signal CS="1". Also, the bass note key code forming curcuit 28 generates bass note key code data and a data category signal BS="1" based on the chord name data CND indicative of the abovesaid triad and also on the bass note decisive data BSP.

Figure 2:
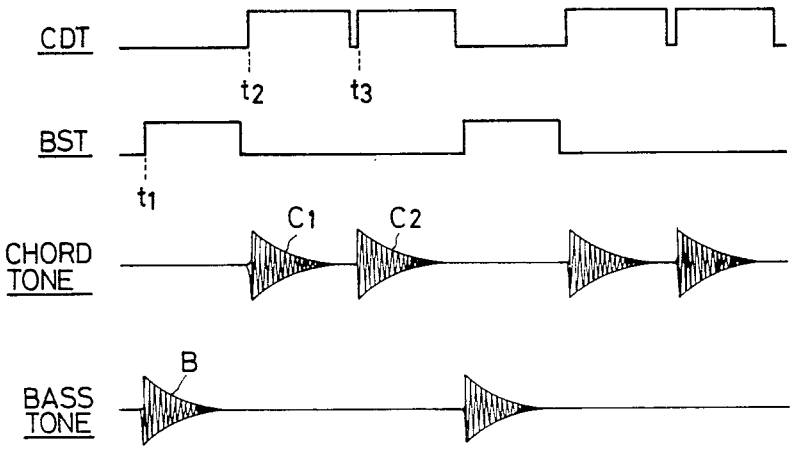
FIG. 2 is a time chart showing the tone production timings of chord tones and bass tones.

Let us now assume that the bass timing signal BST has become "1" at a timing $t_1$ as shown in FIG. 2. The channel assignment controlling circuit 34 delivers out sequential pulses $P_3$ and $P_4$ to serve as the channel assignment timing signal CDCH for the chord tones, and also delivers out a pulse $P_5$ to serve as the channel assignment timing signal BSCH for the bass tone. At such a time, however, the chord timing signal CDT is "0", and accordingly, the channel assignment 64 does not perform channel assignment operation in correspondence to the timing signal CDCH, and as a result, no chord tones are sounded.

The channel assignment circuit 64 generates a load instruction signal LD at the timing of the pulse $P_5$ in accordance with the data category signal BS and with the timing signal BSCH. In accordance therewith, bass note key code data is loaded onto the fifth memory channel of the key data memory 68, and thereafter it is stored there in a circulatory manner. Also, "1" is loaded onto the fifth memory channel of the key-on register in synchronism with the loading of data onto the memory 68, and thereafter it is stored there in a circulatory manner.

In the tone color register circuit 66, a tone color data for the bass tone is stored in the fifth memory channel in accordance with the channel assignment timing signal BSCH for the bass tone, as stated above.

Accordingly, the tone signal generating circuit 80 generates a bass tone signal based on the bass note key code data supplied from the key data memory 68, the tone generation control signal KON from the key-on register, and the tone color data for the bass tone from the tone color data register circuit 66, as shown at B in FIG. 2. In response thereto, a bass tone is sounded from the loudspeaker 84. At such a time, when one or two keys are depressed in the upper keyboard region, the melody tone or tones for the depressed keys are sounded also from the loudspeaker 84.

Next, let us assume that the chord timing signal CDT has become "1" at the timing $t_2$ as shown in FIG. 2. Whereupon, the channel assignment controlling circuit 34 delivers out sequential pulses $P_3 \sim P_5$ to serve as the channel assignment timing signal DDCH for chord tones.

In case of the mode signal FC="1", the channel assignment circuit 64 receives a data category signal CD as the data category signal CDS, and it generates a load instruction signal LD at the timings of the pulses $P_3 \sim P_5$ of the timing signal CDCH. In response thereto, chord constituent note key code data supplied from the key coder 20 are loaded onto the third to fifth memory channels of the key data memory 68, respectively, and thereafter they are stored there in a circulatory manner. Also, in synchronism with the loading of data onto the memory 68, "1" is loaded onto the third to fifth memory channels of the key-on register, respectively, and thereafter it is stored there in a circulatory manner.

In case of the mode signal SF="1", the channel assignment circuit 64 receives a data category signal CD as the data category signal CDS, and it generates a load instruction signal LD at the timings of the pulses $P_3 \sim P_5$ of the timing signal CDCH. In response thereto, chord constituent note key code data supplied from the chord constituent note key code forming circuit 28 are loaded onto the third to fifth memory channels, respectively, of the key data memory 68, and thereafter they are stored there in a circulatory manner. Also, in synchronism with the loading of the data onto the memory 68, "1" is stored onto the third to fifth memory channels, respectively, of the key-on register, in a manner similar to that just mentioned above.

In each case of the mode signal FC="1" and SF="1", in the tone color data register circuit 66, a tone color data for the chord tones is stored in the third to fifth memory channels, respectively, in accordance with the channel assignment timing signal CDCH for the chord tone, as stated above.

Accordingly, the tone signal generating circuit 80 generates chord tone signal based on the chord constituent note key code data supplied from the key data memory 68, the tone generation control signal KON from the key-on register, and the tone color data for the chord tone from the tone color data register circuit 66, as shown as $C_1$ in FIG. 2. In response thereto, the chord tones are sounded from the loudspeaker 84. When, at such a time, one or two keys are depressed in the upper keyboard region, melody tones representing the depressed keys are sounded also from the loudspeaker 84.

Let us assume now that the chord timing signal CDT has become "1" at the timing $t_3$ as shown in FIG. 2. Whereupon, a chord note signal $C_2$ is generated in a manner similar to that described above.

It should be noted that, in the above-mentioned embodiment, one of the tone production channels for the chord tones is utilized for the production of the bass tone. In case, however, there are provided a greater number of tone production channels for melody tones, it is also possible to utilize one of the tone production channels for melody notes for the production of the bass tone. It should be noted here also that, not only the above-described combination of the chord tones and the bass tone, but also for the combination of any other kinds accompaniment tones as well, it is possible to utilize for a certain kind of tone, one of the plurality of tone production channels for the other kind of tone by performing changeover control of channel assignment operation in accordance with the timing signals, provided that if these kinds of accompaniment tones to be combined are those that will never be sounded simultaneously or those that may not be sounded simultaneously (i.e. no serious harm).

As described above, the present invention provides the arrangement that one of a plurality of tone production channels is used in common for the production of the accompaniment tone and the production of another tone. Therefore, there is no need to provide a further special tone production channel exclusively intended for the another tone, so that the number of the channels can be kept unincreased. Also, because of this limited number of channels, it is possible to lower the frequency of the clock pulse signal which is used for the channel assignment of the production of tones, thus providing also the advantage of making circuit designing easy.

What is claimed is:

1. An electronic musical instrument, comprises:

keyboard means having keys representing respective notes and being capable of being depressed;

key data producing means for producing a plurality of key data respectively representing a plurality of tones to be sounded based on depression of the keys in said key-board means;

tone production means having a plurality of tone production channels each for producing a tone as designated by any one of said key data;

channel assignment means for respectively assigning a plurality of said key data supplied from said key data producing means to said plurality of tone production channels of said tone production means each to designate a tone to be produced therefrom; the improvement wherein said key data producing means comprises:

first key data producing means for producing a plurality of first key data respectively representing a plurality of tones to be produced as a first kind of performance based on the depression of the key or keys in said keyboard means;

accompaniment pattern generating means for generating accompaniment controlling data and accompaniment timing signals in a predetermined accompaniment pattern; and second key data producing means for producing second key data representing accompaniment tones to be produced as a second kind of performance based on the depression of the key or keys in said keyboard means and on said accompaniment controlling data, said electronic musical instrument further comprising:

controlling means for supplying a controlling signal to said channel assignment means to thereby cause this latter means to perform a first operation of assigning said plurality of first key data respectively to said plurality of tone production channels when said accompaniment timing signal does not instruct the production of said accompaniment tone, and to perform a second operation of assigning said second key data, one at a time, to one of said plurality of tone production channels when said accompaniment timing signal instructs the production of said accompaniment tone.

2. An electronic musical instrument according to claim 1, wherein:

said first key data producing means forms a plurality of key code data representative of chord constituent notes thus making said first kind of performance a chord performance; and said second key data producing means forms key code data representative of bass tones thus making said second kind of performance an automatic bass performance.

* * * * *